US007622233B2

(12) United States Patent
Patel et al.

(10) Patent No.: US 7,622,233 B2
(45) Date of Patent: Nov. 24, 2009

(54) STYRENE-BASED TONER COMPOSITIONS WITH MULTIPLE WAXES

(75) Inventors: Raj D. Patel, Oakville (CA); Edward G. Zwartz, Mississauga (CA); T. Brian McAneney, Burlington (CA); Edward C. Hanzlik, Fairport, NY (US); Alan R. Kuntz, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 541 days.

(21) Appl. No.: 11/464,367

(22) Filed: Aug. 14, 2006

(65) Prior Publication Data

US 2007/0254229 A1 Nov. 1, 2007

Related U.S. Application Data

(60) Provisional application No. 60/745,949, filed on Apr. 28, 2006.

(51) Int. Cl.
*G03G 9/08* (2006.01)
*G03G 15/08* (2006.01)

(52) U.S. Cl. ..... 430/108.4; 430/109.3; 430/123.5; 430/108.24

(58) Field of Classification Search ..... 430/108.4, 430/109.3, 108.24, 123.5
See application file for complete search history.

(56) References Cited

U.S. PATENT DOCUMENTS

| | | | | |
|---|---|---|---|---|
| 3,847,604 | A | 11/1974 | Hagenbach et al. | |
| 4,291,111 | A | 9/1981 | Lu | |
| 4,935,326 | A | 6/1990 | Creatura et al. | |
| 4,937,166 | A | 6/1990 | Creatura et al. | |
| 5,278,020 | A | 1/1994 | Grushkin et al. | |
| 5,290,654 | A | 3/1994 | Sacripante et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,348,832 | A | 9/1994 | Sacripante et al. | |
| 5,364,729 | A | 11/1994 | Kmiecik-Lawrynowicz et al. | |
| 5,366,841 | A | 11/1994 | Patel et al. | |
| 5,370,963 | A | 12/1994 | Patel et al. | |
| 5,403,693 | A | 4/1995 | Patel et al. | |
| 5,405,728 | A | 4/1995 | Hopper et al. | |
| 5,418,108 | A | 5/1995 | Kmiecik-Lawrynowicz et al. | |
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,869,216 | A | 2/1999 | Ong et al. | |
| 5,869,558 | A | 2/1999 | Hou | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,928,830 | A | 7/1999 | Cheng et al. | |
| 5,977,210 | A | 11/1999 | Patel et al. | |
| 6,057,076 | A * | 5/2000 | Berkes et al. | 430/137.18 |
| 6,130,021 | A | 10/2000 | Patel et al. | |
| 6,294,306 | B1 | 9/2001 | Kmiecik-Lawrynowicz et al. | |
| 6,309,787 | B1 | 10/2001 | Cheng | |
| 6,413,692 | B1 | 7/2002 | Cheng | |
| 6,428,941 | B1 * | 8/2002 | Cheng et al. | 430/109.3 |
| 6,447,974 | B1 | 9/2002 | Chen et al. | |
| 6,576,389 | B2 | 6/2003 | Vanbesien et al. | |
| 6,617,092 | B1 | 9/2003 | Patel et al. | |
| 6,627,373 | B1 | 9/2003 | Patel et al. | |
| 6,638,677 | B2 | 10/2003 | Patel et al. | |
| 6,656,657 | B2 | 12/2003 | Patel et al. | |
| 6,656,658 | B2 | 12/2003 | Patel et al. | |
| 6,664,017 | B1 | 12/2003 | Patel et al. | |
| 6,936,392 | B2 * | 8/2005 | Sato | 430/109.3 |
| 7,300,734 | B2 | 11/2007 | McDougall et al. | |
| 7,514,195 | B2 | 4/2009 | Zwartz et al. | |
| 2003/0108808 | A1 * | 6/2003 | Inoue et al. | 430/108.8 |
| 2004/0137351 | A1 * | 7/2004 | Sato | 430/108.8 |
| 2004/0142264 | A1 | 7/2004 | Tanaka et al. | |
| 2004/0142266 | A1 * | 7/2004 | Sacripante et al. | 430/109.3 |
| 2005/0208405 | A1 * | 9/2005 | Ayaki et al. | 430/108.4 |
| 2005/0287459 | A1 * | 12/2005 | Moffat et al. | 430/108.22 |
| 2005/0287460 | A1 * | 12/2005 | Moffat et al. | 430/108.22 |
| 2006/0121380 | A1 | 6/2006 | Skorokhod | |
| 2006/0121384 | A1 | 6/2006 | Patel et al. | |
| 2006/0121387 | A1 | 6/2006 | Zwartz et al. | |
| 2006/0154162 | A1 * | 7/2006 | Zhou et al. | 430/108.1 |
| 2007/0042286 | A1 * | 2/2007 | Vanbesien et al. | 430/137.14 |
| 2007/0111129 | A1 | 5/2007 | Patel et al. | |
| 2007/0111130 | A1 | 5/2007 | Vanbesien et al. | |

FOREIGN PATENT DOCUMENTS

| | | |
|---|---|---|
| EP | 1 094 367 A1 | 4/2001 |
| EP | 1 615 079 A2 | 1/2006 |

* cited by examiner

*Primary Examiner*—Christopher RoDee
(74) *Attorney, Agent, or Firm*—Oliff & Berridge, PLC

(57) ABSTRACT

A toner composition includes a styrene-based polymer resin, a crystalline polyester wax, a second wax different from the crystalline polyester wax, a colorant, and a coagulant.

19 Claims, No Drawings

STYRENE-BASED TONER COMPOSITIONS WITH MULTIPLE WAXES

This nonprovisional application claims the benefit of U.S. Provisional Application No. 60/745,949, filed Apr. 28, 2006.

TECHNICAL FIELD

This disclosure is generally directed to toner compositions and processes. More specifically, this disclosure is directed to toner compositions and processes, such as emulsion aggregation toner processes, for preparing toner compositions comprising a styrene-based polymer resin, a crystalline polyester wax, a second wax, and a colorant.

RELATED APPLICATIONS

Commonly assigned, U.S. patent application Ser. No. 11/272,720 filed Nov. 15, 2005, describes a toner composition comprising: a resin substantially free of cross linking and having a weight average molecular weight of from about 50,000 to about 1,000,000; a wax; a colorant; and a coagulant. The toner composition can be made by a process comprising: mixing a resin substantially free of cross linking and having a weight average molecular weight of from about 50,000 to about 1,000,000, a wax, a colorant, and a coagulant to provide toner size aggregates; optionally, adding additional resin substantially free of cross linking and having a weight average molecular weight of from about 50,000 to about 1,000,000 to the formed aggregates thereby providing a shell over the formed aggregates; heating the aggregates to form toner; and optionally, isolating the toner.

Commonly assigned, U.S. patent application Ser. No. 11/272,789 filed Nov. 15, 2005, describes a toner composition comprising: a reactive resin substantially free of cross linking; a wax; and a colorant. The toner composition can be made by a process comprising: mixing a reactive resin substantially free of cross linking, a wax, a colorant, and a coagulant to provide toner size aggregates; optionally, adding additional reactive resin substantially free of cross linking to the formed aggregates thereby providing a shell over the formed aggregates; heating the aggregates to form toner; and optionally, isolating the toner.

Commonly assigned, U.S. patent application Ser. No. 11/003,176 filed Dec. 3, 2004, describes toner compositions comprising a non cross linked resin, a cross linked resin, a wax, a pigment dispersion, and a coagulant of a poly metal halide providing a toner having selected characteristics such as excellent fusing characteristics.

Commonly assigned, U.S. patent application Ser. No. 11/003,966 filed Dec. 3, 2004, describes toner processes comprising developing an image on a document having a toner composition applied to the document, wherein the toner composition comprises a resin substantially free of cross linking, a cross linked resin, a wax, and a colorant; and wherein the developed document possesses the characteristic of resistance to adverse effects of electron beam irradiation. In embodiments, the processes further include, during fusing, migrating the wax and cross linked resin to the surface of the toner particles thereby imparting protection to the toner particles against exposure to elevated temperatures.

Commonly assigned, U.S. patent application Ser. No. 11/003,297 filed Dec. 3, 2004, describes toner compositions comprising a non cross linked resin; a cross linked resin; a wax; and a conductive colorant, wherein the compositions have an optimized colorant loading to provide image quality in combination with alleviation or elimination of undesirable effects associated with inductive charging.

Commonly assigned, U.S. patent application Ser. No. 11/003,256 filed Dec. 3, 2004, describes a toner composition comprising a binder, colorant, and a charge control surface additive mixture comprising a mixture of a first titanium dioxide possessing a first conductivity and a second titanium dioxide possessing a second conductivity and which second conductivity is dissimilar from the first conductivity; wherein the mixture of the first titanium dioxide and the second titanium dioxide is selected in a ratio sufficient to impart a selected triboelectric charging characteristic to the toner composition.

Commonly assigned, U.S. patent application Ser. No. 11/003,581 filed Dec. 3, 2004, discloses a toner composition comprising a resin substantially free of cross linking, a cross linked resin, a wax, and a colorant. In embodiments, the toner composition can be made by mixing a resin substantially free of cross linking and a cross linked resin in the presence of a wax, a colorant, and a coagulant to provide toner size aggregates, adding additional resin substantially free of cross linking to the formed aggregates thereby providing a shell over the formed aggregates, heating the shell covered aggregates to form toner, and optionally, isolating the toner.

The appropriate components and process aspects of each of the foregoing may be selected for the present disclosure in embodiments thereof, and the entire disclosure of the above-mentioned applications are totally incorporated herein by reference.

REFERENCES

U.S. Pat. No. 6,447,974 describes in the Abstract a process for the preparation of a latex polymer by (i) preparing or providing a water aqueous phase containing an anionic surfactant in an optional amount of less than or equal to about 20 percent by weight of the total amount of anionic surfactant used in forming the latex polymer; (ii) preparing or providing a monomer emulsion in water which emulsion contains an anionic surfactant; (iii) adding about 50 percent or less of said monomer emulsion to said aqueous phase to thereby initiate seed polymerization and to form a seed polymer, said aqueous phase containing a free radical initiator; and (iv) adding the remaining percent of said monomer emulsion to the composition of (iii) and heating to complete an emulsion polymerization thus forming a latex polymer.

U.S. Pat. No. 6,413,692 describes in the Abstract a process comprising coalescing a plurality of latex encapsulated colorants and wherein each of said encapsulated colorants are generated by miniemulsion polymerization.

U.S. Pat. No. 6,309,787 describes in the Abstract a process comprising aggregating a colorant encapsulated polymer particle containing a colorant with colorant particles and wherein said colorant encapsulated latex is generated by a miniemulsion polymerization.

U.S. Pat. No. 6,294,306 describes in the Abstract toners which include one or more copolymers combined with colorant particles or primary toner particles and a process for preparing a toner comprising (i) polymerizing an aqueous latex emulsion comprising one or more monomers, an optional nonionic surfactant, an optional anionic surfactant, an optional free radical initiator, an optional chain transfer agent, and one or more copolymers to form emulsion resin particles having the one or more copolymers dispersed therein; (ii) combining the emulsion resin particle with colorant to form statically bound aggregated composite particles;

(iii) heating the statically bound aggregated composite particles to form toner; and (iv) optionally isolating the toner.

U.S. Pat. No. 6,130,021 describes in the Abstract a process involving the mixing of a latex emulsion containing resin and a surfactant with a colorant dispersion containing a nonionic surfactant, and a polymeric additive and adjusting the resulting mixture pH to less than about 4 by the addition of an acid and thereafter heating at a temperature below about, or equal to about, the glass transition temperature (Tg) of the latex resin, subsequently heating at a temperature above about, or about equal to, the Tg of the latex resin, cooling to about room temperature, and isolating the toner product.

U.S. Pat. No. 5,928,830 describes in the Abstract a process for the preparation of a latex comprising a core polymer and a shell thereover and wherein the core polymer is generated by (A) (i) emulsification and heating of the polymerization reagents of monomer, chain transfer agent, water, surfactant, and initiator; (ii) generating a seed latex by the aqueous emulsion polymerization of a mixture comprised of part of the (i) monomer emulsion, from about 0.5 to about 50 percent by weight, and a free radical initiator, and which polymerization is accomplished by heating, and, wherein the reaction of the free radical initiator and monomer produces a seed latex containing a polymer; (iii) heating and adding to the formed seed particles of (ii) the remaining monomer emulsion of (I), from about 50 to about 99.5 percent by weight of monomer emulsion of (i) and free radical initiator; (iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator; (ii) adding a free radical initiator and heating; (iii) whereby there is provided said shell polymer.

U.S. Pat. No. 5,869,558 describes in the Abstract dielectric black particles for use in electrophoretic image displays, electrostatic toner or the like, and the corresponding method of manufacturing the same. The black particles are latex particles formed by a polymerization technique, wherein the latex particles are stained to a high degree of blackness with a metal oxide.

U.S. Pat. No. 5,869,216 describes in the Abstract a process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25 degrees C. to about 80 degrees C.; and optionally isolating the toner product, washing, and drying. Additional patents of interest include U.S. Pat. Nos. 5,766,818; 5,344,738; and 4,291,111.

The disclosures of each of the foregoing U.S. patents are hereby incorporated by reference herein in their entireties. The appropriate components and process aspects of the each of the foregoing U.S. patents may also be selected for the present compositions and processes in embodiments thereof.

BACKGROUND

For both black and color prints, a small particle size toner is known to improve the image quality of the prints. High speed black and white printers require toner particles that can provide a matte finish in an oil-less fuser system with a low minimum fixing temperature (MFT) to enable high speed printing and at the same time achieve superior image quality in the resultant printed product.

Numerous patents and patent applications, including those above, have described various routes for providing ultra low melt toner compositions. Many of the approaches have focused on polyester-based toner compositions, as polyester resins are typically compatible with fuser oils typically used in electrostatographic imaging systems, which oils are generally not compatible with styrene resins. For example, when a styrene-based resin toner composition is used with an amino or silicone fuser oil release agent, the result is that the minimum fixing temperature of the toner increases to more than 230° C., or nearly 40° C. over the desired fusing temperature. However, it is generally believed in the art that the design space for styrene-based toner compositions has been so thoroughly explored, that styrene-based toner compositions cannot be used in ultra low melt toner applications.

There remains a need for an improved toner composition and process, which overcome or alleviate the above-described and other problems experienced in the art. There further remains a need for a toner composition suitable for high speed printing that can provide excellent release and hot offset characteristics, minimum fixing temperature, and suitable small toner particle size characteristics.

SUMMARY

The present disclosure addresses these and other needs, by providing improved toner compositions and preparation processes for making emulsion/aggregation toner compositions. The disclosure provides improved toner composition materials, thereby providing excellent toner release, hot offset characteristics, and minimum fixing temperature.

In embodiments, the present disclosure provides toner compositions that include a styrene-based polymer resin, a crystalline polyester wax, a second wax, and a colorant. The toner composition can also have a shell material over the toner particles. By using the combination of a crystalline polyester wax and a second wax with a styrene-based polymer resin, the toner composition design space for styrene-based polymer resins is opened to allow their use in low melt and ultra low melt toner applications. The combination of waxes and resin provides a toner composition with gloss, minimum fixing temperature, document offset and vinyl offset properties comparable to polyester-based resin toner compositions, and which can be used in oil-less fusing systems.

In an embodiment, the present disclosure provides a toner composition comprising:

a styrene-based polymer resin;

a crystalline polyester wax;

a second wax different from said crystalline polyester wax;

a colorant; and a coagulant.

In another embodiment, the present disclosure provides a toner process comprising:

mixing a styrene-based polymer resin, a crystalline polyester wax, a second wax different from said crystalline polyester wax, a colorant, and a coagulant to provide toner size aggregates;

optionally, adding additional styrene-based polymer resin to the formed aggregates thereby providing a shell over the formed aggregates;

heating the aggregates to form toner; and optionally, isolating the toner.

EMBODIMENTS

Toner compositions will now be described comprising a styrene-based polymer resin, a crystalline polyester wax, a second wax, and a colorant. Also there will be described a process for preparing a toner comprising mixing a styrene-based polymer resin, a crystalline polyester wax, a second wax, a colorant, and a coagulant to provide toner size aggregates; adding additional resin latex to the formed aggregates thereby providing a shell over the formed aggregates; heating the shell covered aggregates to form toner; and, optionally, isolating the toner. In embodiments, the toner process includes providing an anionic surfactant in an amount of for example about 0.01% to about 20% by weight based upon a total weight of the reaction mixture; wherein for example the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof. In further embodiments, the shell thus formed has, for example, a thickness of about 0.3 to about 0.8 micrometers.

Latex Resin or Polymer

Illustrative examples of specific latex for resin, polymer or polymers selected for the toner are styrene-based monomers, including styrene acrylate-based monomers. Thus, for example, examples of styrene-based monomer and acrylate-based monomers and polymers include, for example, styrene, styrene acrylates, styrene methacrylates, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), styrene/butyl acrylate/carboxylic acid terpolymers, styrene/butyl acrylate/beta-carboxy ethyl acrylate terpolymers, and other similar polymers. In the above materials, the alkyl group can have, for example, from 1 to about 40 carbon atoms, such as 1 to about 10 or to about 20 carbon atoms, or 1 to about 5 carbon atoms.

The monomers used in making the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Mixtures of two or more of polymers can also be used, if desired.

In embodiments the resin may be selected to contain a carboxylic acid group selected, for example, from the group comprised of, but not limited to, acrylic acid, methacrylic acid, itaconic acid, beta carboxy ethyl acrylate (beta CEA), fumaric acid, maleic acid, and cinnamic acid, and wherein, for example, a carboxylic acid is selected in an amount of about 0.1 to about 10 weight percent of the total weight of the resin.

In embodiments, the latex emulsion polymer is a styrene polymer, such as a styrene-alkyl acrylate polymer, or a mixture of two or more such styrene polymers or styrene-alkyl acrylate polymers. For example, in one embodiment, the latex emulsion polymer is a styrene/butyl acrylate/β-carboxy ethyl acrylate terpolymer. In other embodiments, the resin or polymer can be styrene/butyl acrylate/acrylic acid terpolymer, styrene/butyl acrylate/methacrylic acid terpolymer, styrene/butyl acrylate/itaconic acid terpolymer, styrene/butyl acrylate/furmaic acid terpolymer, styrene/butadiene/beta-carboxyethylacrylate terpolymer, styrene/butadiene/methacrylic acid terpolymer, styrene/butadiene/acrylic acid terpolymer, styrene/isoprene/beta-carboxyethylacrylate terpolymer and the like.

In embodiments, the resin comprises styrene:butylacrylate:beta-carboxy ethyl acrylate wherein, for example, the non cross linked resin monomers are present in an amount of about 70% to about 90% styrene, about 10% to about 30% butylacrylate, and about 0.05 parts per hundred to about 10 parts per hundred beta-CEA, such as about 3 parts per hundred beta-CEA, by weight based upon the total weight of the monomers. However, the component ratios are not limited to these ranges, and other amounts can be used.

In a feature herein, the resin comprises about 73% to about 85% styrene, about 27% to about 15% butylacrylate, and about 1.0 part per hundred to about 5 parts per hundred beta-CEA, by weight based upon the total weight of the monomers although the compositions and processes are not limited to these particular types of monomers or ranges. In another feature, the resin comprises about 81.7% styrene, about 18.3% butylacrylate, and about 3.0 parts per hundred beta-CEA, by weight based upon the total weight of the monomers.

Known chain transfer agents, for example dodecanethiol or carbon tetrabromide, can be utilized to control the molecular weight properties of the polymer. The chain transfer agent may be present in an amount of from about 0.5 to about 5.0 percent by weight based upon the combined weight of the monomers, although not limited. An initiator may be used in forming the resin, such as sodium, potassium or ammonium persulfate and may be present in an amount of, for example, about 0.5 to about 3.0 percent based upon the weight of the monomers, although not limited. In embodiments, a surfactant can be used, such as an anionic surfactant present in the range of about 0.7 to about 5.0 percent by weight based upon the weight of the aqueous phase, although not limited to this type or range.

Although not limited to any particular resins or properties, the polymer resin used in forming the toner composition in embodiments can be quantified by various physical properties. For example, in embodiments, the polymer resin can have a weight average molecular weight (Mw) of about 25,000 to about 50,000, such as about 30,000 to about 40,000 or about 35,000, a number average molecular weight (Mn) of about 7,000 to about 20,000, such as about 9,000 to about 15,000 or about 10,000 to about 12,000, and a Tg (onset) of about 48° C. to about 62° C., such as about 49° C. to about 55° C. or about 51° C. to about 54° C.

In embodiments, the selected styrene-based polymer resin is a non cross linked resin that is substantially free of cross linking. As used herein, "substantially free of cross linking" (also referred to herein as a non cross linked resin) refers for example to a resin having less than about 10 percent, such as less than about 5 percent, less than about 1 percent, or less than about 0.1 percent, cross linking between polymer chains. Thus, in embodiments, the resin latex is substantially free of cross-linking as to any functional groups that may be present in the resin, meaning that the entire resin latex has less than about 10 percent, such as less than about 5 percent, less than about 1 percent, or less than about 0.1 percent, cross linking.

In embodiments, such as where the toner composition includes a polymer shell around the aggregate particles as described below, the binder resin of the core of the toner composition can be the same as or different from the binder resin of the shell. In this embodiment, the core and shell resins can be the same resin, that is, the same types and amounts of monomers, the same molecular weight, and the like, or they can be different resins, that is different in at least one aspect such as different types and/or amounts of constituent monomers, different molecular weight, different properties, or the like. In still other embodiments, the core and/or shell resins, when present, can include other resins in addition to the non cross linked resin.

As will be apparent, the properties of the non cross linked resin can be suitably adjusted by adjusting the types and amounts of constituent monomers, adjusting the type and amount of chain transfer agents, and the like. For example, adjusting the ratio of constituent monomers can adjust the toner glass transition temperature (Tg), which in turn can effect toner blocking properties, fusing properties, and the like.

Likewise, adjusting the amount of chain transfer agent used in forming the resin latexes used for the core and/or shell resin components, can adjust resin properties. For example, using different amounts of chain transfer agent, such as dodecanethiol, when forming the resin latex, can change the resin's properties such as molecular weight, glass transition temperature, and the like. For example, increasing the amount of chain transfer agent in forming the core resin latex, can decrease the molecular weight due to chain termination during polymerization; while decreasing the amount of chain transfer agent in forming the shell resin latex will increase the molecular weight, which can aid in toner blocking properties.

The monomer units used to form the resin latex or latexes can be suitably polymerized by any known process. For example, the monomer units can be polymerized in a starve fed semi-continuous emulsion polymerization process, a standard emulsion polymerization process, or the like, to provide the resin latex. Such polymerizations can be carried out, for example, in the presence of an initiator, a chain transfer agent (CTA), surfactant, and the like.

For example, the monomers can be polymerized under starve fed conditions as referred to in U.S. Pat. Nos. 6,447,974, 6,576,389, 6,617,092, and 6,664,017, the entire disclosure of which are incorporated herein by reference, to provide latex resin particles having a diameter in the range of about 100 to about 300 nanometers.

Surfactants

For example, surfactants in amounts of about 0.01 to about 20, or about 0.1 to about 15 weight percent of the reaction mixture in embodiments can be used. Examples of suitable surfactants include, for example, nonionic surfactants such as dialkylphenoxypoly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897.™ For example, an effective concentration of the nonionic surfactant is, in embodiments, from about 0.01 percent to about 10 percent by weight, or from about 0.1 percent to about 5 percent by weight of the reaction mixture.

Examples of anionic surfactants being include sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC.™, available from Kao, Dowfax 2A1 (hexa decyldiphenyloxide disulfonate) and the like, among others. For example, an effective concentration of the anionic surfactant generally employed can be from about 0.01 percent to about 10 percent by weight, or from about 0.1 percent to about 5 percent by weight of the reaction mixture One or more bases can also be used to increase the pH and hence ionize the aggregate particles thereby providing stability and preventing the aggregates from growing in size. Examples of bases that can be selected include sodium hydroxide, potassium hydroxide, ammonium hydroxide, cesium hydroxide and the like, among others.

Additional surfactants can also optionally be added to the aggregate suspension prior to or during the coalescence. Such additional surfactants can be used, for example, to prevent the aggregates from growing in size, or for stabilizing the aggregate size, with increasing temperature. Suitable additional surfactants can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-72™, IGEPAL CO-890™, IGEPAL CO-720™, IGEPAL CO-290™, IGEPAL CA-210™, ANTAROX 890™ and ANTAROX 897 ™. An effective amount of the anionic or nonionic surfactant generally employed as an aggregate size stabilization agent is, for example, about 0.01 percent to about 10 percent or about 0.1 percent to about 5 percent, by weight of the reaction mixture.

Examples of the acids that can be utilized include, for example, nitric acid, sulfuric acid, hydrochloric acid, acetic acid, citric acid, trifluoro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Wax

The toner composition also includes a combination of two or more different waxes. The first wax is a crystalline polyester wax, and the second wax is a different wax. The two or more waxes in the hybrid wax system are different waxes, to provide desired properties of the toner compositions. The two or more waxes are different, for example, in terms of at least one physical or chemical property, to provide different performance characteristics to the toner composition. Thus, for example, one wax can be selected for its gloss properties, while another wax can be selected for its toner particle shape, presence and amount of wax on the toner particle surface, charging and/or fusing characteristics, stripping, offset properties, or the like. Thus, for example, the waxes can be selected such that a first wax provides improved results in terms of a first property over a second wax, while the second wax provides improved results in terms of a second property over the first wax. The waxes are also desirably selected such that they do not adversely interact or react with each other, to provide inferior or an unusable toner product.

The first wax component is a crystalline polyester wax. As used herein, "crystalline polyester wax" refers for example to a polyester wax material that contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer.

The crystalline polyester wax is not particularly limited, and can be any suitable crystalline polyester wax. In general, polyester waxes are made of ethylene glycol diesters or triesters of long-chain fatty acids, such as having about 18 to about 36 carbon atoms. However, suitable crystalline polyester waxes can be formed from long-chain fatty acids having shorter or longer chains, such as about 10 to about 50 carbon atoms, such as about 10 to about 18 carbon atoms, about 18 to about 36 carbon atoms, or about 36 to about 50 carbon atoms, such as about 25 to about 45 carbon atoms. Their melting points range between about 60-75° C. and can be used to add stiffness and crystallinity. Polyester waxes are made to provide different physical properties. Straight chain esters, such as cetyl palmitate and cetostearyl stearate, are generally solid at room temperature. Branched chain esters, such as isopropyl myristate or cetostearyl ethylhexanoate, generally provide good spreading properties. These waxes may be selected from among any of the low melting point hydrophobic semi-crystalline polyester waxes evidencing a weight average molecular weight of from about 5,000 to about 80,000 and having a melting temperature of about 55° C. to about 120° C. Many such waxes are commonly available from commercial sources. Waxes found to be particularly useful for this purpose include both aliphatic and aromatic semi-crystalline polyesters. The aliphatic semi-crystalline polyester waxes include: poly(butylene adipate), poly(hexamethylene sebecate), poly(decamethylene sebecate), and poly[hexamethylene-co-tetramethylene (80/20) cyclohexane dicarboxylate]. The semi-crystalline aromatic waxes include: poly[hexamethylene terephthalate-co-succinate (70/30)], poly[hexamethylene-co-tetramethylene (80/20)-terephthalate-co-isophthalate (80/20)], poly[hexamethylene-co-tetramethylene (80/20)-naphthonate-co-isophthalate (80/20)], poly [hexamethylene-co-2,2-dimethyl propylene (80/20)-terephthalate], and poly[hexamethylene-co-2,2-dimethylpropylene (80/20) naphthonate].

The crystalline polyester waxes, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline polyester waxes include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly (octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly(butylene-adipate), alkali copoly (5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfo-isophthaloyl)-copoly(ethylene-succinate), alkali copoly(5-sulfo-isophthaloyl-copoly(butylene-succinate), alkali copoly(5-sulfo-isophthaloyl)-copoly (hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly (ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), alkali copoly (5-sulfo-isophthaloyl)-copoly(hexylene-adipate), poly (octylene-adipate); and wherein alkali is a metal of sodium, lithium or potassium, and the like. In embodiments, the alkali metal is lithium.

The crystalline polyester wax can be present, for example, in an amount of about 10% to about 50% by weight based upon the total weight of the composition. For example, in embodiments, the crystalline polyester wax can be present in an amount of about 15% to about 40%, such as about 20% to about 30% or about 35%, by weight based upon the total weight of the composition. In some embodiments, the crystalline polyester wax is present in an amount of greater than 20%, such as 22% to about 50%, by weight based upon the total weight of the composition.

Although not limited, the crystalline polyester wax in embodiments has a peak melting point of about 50° C. to about 95° C., such as about 55° C. or about 60° C. to about 80° C. or about 85° C., such as about 70° C., and has a recrystallization peak temperature of about 45° C. to about 75° C., such as about 50° C. or about 55° C. to about 65° C. or about 70° C.

In embodiments, the crystalline polyester wax is a highly crystalline material, such as having a crystallinity of about 55 to 100%. Here, the crystallinity percent can be measured, for example, by X-ray diffraction, differential scanning calorimetery, and the like. The crystallinity percent (Xc) can in turn be defined by the formula: $Xc=Sc/(Sc+Sa)\times 100$, where Sc is the crystallinity component and Sa is the amorphous component. For example, the crystalline polyester can have a crystallinity of about 55 to 100% or to about 100%, such as about 60% or about 70% to about 80% or about 90%. Of course, values outside these ranges can also be used. Furthermore, in embodiments, the X-ray diffraction pattern of the crystalline polyester wax can have a peak at about 20 to about 26°, as measured at 2theta.

Another property that can be used in embodiments to describe the crystalline polyester wax is the heat of fusion, measured by differential scanning calorimetery. For example, in some embodiments, the crystalline polyester wax can have a heat of fusion of about 170 to about 296 J/g, regardless of the heating or recrystallization (cooling) cycle rates. Of course, crystalline polyester waxes having other values can also be used.

The second wax component is any suitable wax other than a crystalline polyester wax. That is, the second wax is different from the crystalline polyester wax such as in its chemical structure.

For example, waxes suitable for use as the second wax component in embodiments include alkylene waxes such as alkylene wax having about 1 to about 25 carbon atoms, such as polyethylene, polypropylene or mixtures thereof. Examples of waxes include those as illustrated herein, such as those of the aforementioned co-pending applications, polypropylenes and polyethylenes commercially available from Allied Chemical and Petrolite Corporation such as PW655 available from Baker Petrolite and other fractionated polyethylenes such as FNP-0092, wax emulsions available from Michaelman Inc. and the Daniels Products Company, Epolene N–15™ commercially available from Eastman Chemical Products, Inc., Viscol 550-P™, a low weight average molecular weight polypropylene available from Sanyo Kasei K.K., and similar materials. The commercially available polyethylenes possess, it is believed, a weight average molecular weight (Mw) of about 100 to about 3,000, and the commercially available polypropylenes are believed to possess a weight average molecular weight (Mw) of about 1,000 to about 10,000. Examples of functionalized waxes include amines, amides, for example Aqua Superslip 6550™, Superslip 6530™ available from Micro Powder Inc., fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example Joncryl 74™, 89™, 130™, 537™, and 538™, all available from SC Johnson Wax, chlorinated polypropylenes and polyethylenes available from Allied Chemical and Petrolite Corporation and SC Johnson Wax.

The second wax component can be present, for example, in an amount of about 6% to about 15% by weight based upon the total weight of the composition. In embodiments, the second wax component can be present, for example, in an amount of about 8% to about 12%, such as about 9%, by weight based upon the total weight of the composition.

Although not limited, the second wax component in embodiments has a peak melting point of about 65° C. to about 120° C., such as about 70° C. or about 80° C. to about 100° C. or about 110° C., such as about 92° C.

Both the crystalline polyester wax and the second wax component can be provided in any suitable form, such as in powder form, liquid, form, or the like. In embodiments, the waxes can be separately or together provided in the form of a dispersion comprising, for example, a wax having a particle diameter of about 100 nanometers to about 500 nanometers, water, and an anionic surfactant. The surfactant used to disperse the wax can be an anionic surfactant, although not limited thereto, such as, for example, Neogen RK™ commercially available from Kao Corporation or TAYCAPOWER BN2060 commercially available from Tayca Corporation.

Colorant

The toner composition also includes at least one colorant, such as a dye and/or a pigment. For example, colorants include pigment, dye, mixtures of pigment and dye, mixtures of pigments, mixtures of dyes, and the like. For simplicity, the term "colorant" refers for example to such organic soluble dyes, pigments, and mixtures, unless specified as a particular pigment or other colorant component. In embodiments, the colorant comprises carbon black, magnetite, black, cyan, magenta, yellow, red, green, blue, brown, or mixtures thereof, in an amount of about 1% to about 25%, such as about 2% or about 5% to about 15% or about 20%, by weight based upon the total weight of the composition. It is to be understood that other useful colorants will become readily apparent based on the present disclosures.

In general, useful colorants include, but are not limited to, black colorants such as Paliogen Black L9984 (BASF), Pigment Black K801 (BASF) and carbon blacks such as REGAL 330 (Cabot), REGAL 660 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040×(Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

Other useful colorants include, but are not limited to, Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991 K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), and the like.

Coagulant

In embodiments, the coagulants used in the present process comprises know components, such as poly metal halides, for example poly aluminum halides, such as polyaluminum chloride (PAC) or polyaluminum sulfo silicate (PASS). For example, in one embodiment, the coagulants provide a final toner having a metal content of, for example, about 400 to about 10,000 parts per million. In another embodiment, the coagulant comprises a poly aluminum chloride providing a final toner having an aluminum content of about 400 to about 10,000 parts per million, such as about 400 to about 1,000 parts per million. In embodiments, the coagulant can be present in the toner particles, exclusive of external additives and on a dry weight basis, in amounts of from 0 to about 5% by weight of the toner particles, such as from about greater than 0 to about 3% by weight of the toner particles.

Toner Particle Preparation

The toner composition can be, in embodiments, prepared by an emulsion/aggregation process, such as an emulsion/aggregation/coalescing process. For example, emulsion/aggregation/coalescing processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox patents U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. patents may be selected for the present composition and process in embodiments thereof.

In embodiments, the toner preparation process comprises forming a toner particle by mixing the styrene-based polymer resin with the crystalline polyester wax (such as in a dispersion or emulsion), the second wax (such as in a dispersion or emulsion), and a colorant dispersion, to which is added a coagulant of for example, a poly metal halide such as polyaluminum chloride while blending at high speeds such as with a polytron. The resulting mixture having a pH of about 2 to about 3 is aggregated by heating to a temperature below about the resin Tg to provide toner size aggregates. Additional resin latex (which may be the same as or different from the styrene-based polymer resin, as described above) is added to the formed aggregates providing a shell over the formed aggregates. For example, in embodiments, about 10% to about 35% or about 15% to about 30% additional resin latex can be added to the formed aggregates providing a shell over the formed aggregates. The pH of the mixture is then changed by the addition of a base such as a sodium hydroxide solution until a pH of about 7 is achieved. When the mixture reaches a pH of about 7, the carboxylic acid becomes ionized to provide additional negative charge on the aggregates thereby providing stability and preventing the particles from further growth or an increase in the size distribution when heated above the Tg of the latex resin. The temperature of the mixture is then raised to about 95° C. After about 30 minutes, the pH of the mixture is reduced to a value sufficient to coalesce or fuse the aggregates to provide a composite particle upon further heating such as about 4.5. The fused particles can be measured for shape factor or circularity, such as with a Sysmex FPIA 2100 analyzer, until the desired shape is achieved.

The mixture can be allowed to cool to room temperature (about 20° C. to about 25° C.) and can optionally be washed. When the mixture is to be washed, a multiple-step wash procedure can be used, where a first wash is conducted such as at a pH of about 10 and a temperature of about 63° C. followed by a deionized water (DIW) wash at room temperature. This can then be followed by a wash at a pH of about 4.0 at a temperature of about 40° C. followed by a final DIW water wash. The toner can then be dried.

The final toner composition comprises toner particles having a styrene-based polymer resin, a combination of a crystalline polyester wax and a second, different wax, and a colorant. While not wishing to be bound by theory, in the present toner composition comprising a combination of a crystalline polyester wax and a second, different wax, the wax combination allows for the use of a styrene-based polymer resin in low and ultra low melt toners, which was not previously possible. The combination of waxes provides a styrene-based polymer resin toner composition that exhibits, in an embodiment, a minimum fixing temperature such as about 130° C. and that is compatible with oil-less fuser engines, while providing acceptable and desirable gloss, crease, document offset, vinyl offset, and fixing properties. The ability to utilize an oil-less fuser engine, in turn, provides such desirable benefits as extending photoreceptor life, extending fuser life, lessening toner contamination, and the like. Further, the ability to use a styrene-based polymer resin rather than a polyester-based polymer resin allows for production cost reduction, as a styrene-based polymer resins are generally cheaper than polyester-based polymer resins. Despite these advantages of the a styrene-based polymer resin toner composition, the toner provides generally comparable or better results as compared to conventional polyester-based polymer resin toner compositions.

In embodiments, the final toner composition has a gloss, measured at the minimum fixing temperature, of from about 30 to about 80 gloss units, such as from about 40 to about 70 gloss units as measured on a BYK 75 degree micro gloss meter. "Gloss units" refers to Gardner Gloss Units measured on plain paper (such as Xerox 90 gsm COLOR XPRESSIONS+ paper or Xerox 4024 paper). Crease fix MFT is measured by folding images that have been fused over a wide range of fusing temperatures and then rolling a defined mass across the folded area. The print can also be folded using a commercially available folder such as the Duplo D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease fix MFT. In embodiments, the toner compositions have a MFT of about 115° C. to about 145° C., such as about 120° C. to about 140° C. or about 130° C.

In embodiments, the toner comprises a styrene-based polymer resin, a crystalline polyester wax, a second wax, and colorant in an amount of about 40% to about 80% styrene-based polymer resin, about 15% to about 40% crystalline polyester wax, about 4% to about 15% second wax, and about 5% to about 13% colorant, by weight based upon the total weight of the composition wherein a total of the components is about 100%, although not limited thereto. In embodiments, the styrene-based polymer resin, crystalline polyester wax, second wax, and the colorant are present in an amount of about 62% styrene-based polymer resin, about 25% crystalline polyester wax, about 9% wax, and about 4% colorant, by weight based upon the total weight of the composition.

In embodiments of the present toner composition, the resultant toner possesses a shape factor of about 120 to about 140 where a shape factor of 100 is considered to be spherical, and a particle circularity of about 0.900 to about 0.980 such as about 0.930 to about 0.980 as measured on an analyzer such as a Sysmex FPIA 2100 analyzer, where a circularity of 1.00 is considered to be spherical in shape.

In some embodiments, the toner composition can be a black toner composition or a colored toner composition. In embodiments, the toner composition can have a Tg (onset) of from about 50 to about 60° C., a shape factor of about 120 to about 140, and a circularity of about 0.900 to about 0.980. In other embodiments, the toner composition can include a resin that comprises of styrene:butylacrylate:Beta-CEA in the ratio of about 72:28:3 pph by weigh of monomer. In other embodiments, the toner composition can include an optional amount of a resin that comprises styrene:butylacrylate:Beta-CEA:DVB (divinyl benzene) in the ratio of about 65:53:3:1 pph by weight of monomer.

The toner particles can optionally be blended with external additives following formation. Any suitable surface additives may be used in embodiments. Suitable external additives include, for example, $SiO_2$, metal oxides such as $TiO_2$ and aluminum oxide, lubricating agent such as metal salts of fatty acids (such as zinc stearate or calcium stearate), long chain alcohols such as UNILIN® 700, and the like. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is applied to provide lubricating properties. Zinc stearate provides developer conductivity and tribo enhancement, both due to its lubricating nature. The external surface additives can be used with or without a coating.

In embodiments, the toners contain from, for example, about 0.1 to about 5 weight percent titania and/or other metal oxides, about 0.1 to about 8 weight percent silica, and about 0.1 to about 4 weight percent zinc stearate or other metal stearates.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2% to about 10% by weight of toner and about 90% to about 98% by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

In embodiments, the toners of the present disclosure may advantageously be used in combination with an oil-less fuser system in an electrostatographic imaging device. That is, the toners of the present disclosure are advantageously used in combination with a fuser system that does not utilize a fuser release oil, such as amino or silicone oils, that are conventionally used in the art.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Preparation of Styrene-Acrylate Polymer Resin Latex—Latex A:

A latex emulsion comprised of polymer particles generated from the emulsion polymerization of styrene, n-butyl acrylate and beta-CEA was prepared as follows. A surfactant solution consisting of 605 grams Dowfax 2A1 (anionic emulsifier) and 687 kilograms de-ionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80° C. at a controlled rate, and held there. Separately, 6.1 kilograms of ammonium persulfate initiator was dissolved in 30.2 kilograms of de-ionized water.

Separately, the monomer emulsion was prepared in the following manner. 311.4 kilograms of styrene, 95.6 kilograms of butyl acrylate and 12.21 kilograms of β-CEA, 2.88 kilograms of 1-dodecanethiol, 1.42 kilograms of 1,10-decanediol diacrylate (ADOD), 8.04 kilograms of Dowfax 2A1 (anionic surfactant), and 193 kilograms of deionized water were mixed to form an emulsion. 1% of the above emulsion is then slowly fed into the reactor containing the aqueous surfactant phase at 80° C. to form the "seeds" while being purged with nitrogen. The initiator solution is then slowly charged into the reactor and after 10 minutes the rest of the emulsion is continuously fed in a using metering pump at a rate of 0.5%/min. Once all the monomer emulsion is charged into the main reactor, the temperature is held at 80° C. for an additional 2 hours to complete the reaction. Full cooling is then applied and the reactor temperature is reduced to 35° C. The product is collected into a holding tank. After drying the latex, the molecular properties were Mw=35,419, Mn=11,354 and the onset Tg was 51.0° C.

Preparation of Crystalline Sodio Sulfonated Polyester Resin—Emulsion B:

The crystalline polyester resin was prepared comprising 1,6-hexanediol, dimethyl 5 sulphoisophthalate sodium salt and sebacic acid by a polycondensation reaction. All appropriate poly condensation procedures were applied to produce the resin. The result is a crystalline sodio sulfonated polyester resin having a peak melt point of 70° C. The resin was dispersed to provide an emulsion of crystalline sodio sulfonated polyester resin particles in an aqueous medium having a pH of about 9.0. The solids content was 19.6 percent.

Preparation of Pigment Dispersion:

The pigment dispersion used was an aqueous dispersion of Blue 15:3 pigment from Sun Chemicals. The pigment dispersion contained an anionic surfactant. The pigment content of the dispersion was 17%, 2% surfactant, and 81% water.

Example 1

Preparation of Toner 156 grams of Latex A having a solids loading of 40 weight %, 192 grams of Emulsion B having a solids loading of 19.6 weight %, and 45.3 grams of wax emulsion (FNP-0092®, a purified paraffin wax containing $C_{42}$) having a solids loading of 30.50 weight % were added to 500 grams of deionized water in a vessel and stirred using an IKA Ultra Turrax® T50 homogenizer operating at 4,000 rpm. Thereafter, 36.2 grams of cyan pigment dispersion Sun Pigment W1929 (PB 15:3) having a solids loading of 17 weight %, were added to the reactor, followed by drop-wise addition of 23 grams of a flocculent solution containing 2.3 grams polyaluminum chloride mixture and 20.7 grams 0.02 molar nitric acid solution. As the flocculent mixture is added drop-wise, the homogenizer speed was increased to 5,200 rpm and homogenized for an additional 5 minutes. Thereafter, the mixture was heated at 1° C. per minute to a temperature of 45° C. and held there for a period of about 3 hours resulting in a volume average particle diameter of 6.1 microns as measured with a Coulter Counter. Additional 74 grams of Latex A was added to the reactor mixture and allowed to aggregate overnight at 45° C. resulting in a volume average particle diameter of 6.3 microns. 8 grams EDTA (Versene 100) having a solids loading of 39 weight % was added to the aggregates followed by 4.0% sodium hydroxide solution to raise the pH of the reactor contents to 6.5. Thereafter, the reactor mixture is heated at 1° C. per minute to a temperature of 93° C. After about 15 minutes, the pH of the reactor was reduced to 4.8 with 4% nitric acid solution. Following this, the reactor mixture was stirred at 93° C. for 4 hours to enable the particles to coalesce and spherodize. The reactor heater was then turned off, the reactor content was quenched with deionized water, and the reactor mixture was allowed to cool to room temperature.

The particle size obtained was 6.3 microns with a GSD of 1.22. The toner of this mixture comprises about 62 percent styrene/acrylate/Beta-CEA Latex A, about 25 percent crystalline polyester wax Emuslion B, about 3.8 percent PB 15:3 pigment, and about 9 percent by weight FNP-0092 wax. The particles were washed 4 times with deionized water, and freeze dried.

Example 2

Preparation of Toner

Example 1 was repeated, except that the aggregation temperature was raised by 2° C. in order to obtain a slightly bigger particle. The particle size obtained was 8.5 microns.

Comparative Example 1

Preparation of Polyester Toner

A comparative toner is prepared similarly to Examples 1 and 2 above, except that the toner comprises 61 wt % of a sodio sulfonated polyester resin, 30 wt % of the crystalline polyester wax, and 9 wt % of the FNP-0092® wax.

Comparative Example 2

Preparation of Polyester Toner

A comparative toner is prepared containing 12.7% by weight of a dispersion of PV Fast Blue in SPARII (3.8% by weight pigment loading total) in a propoxylated bisphenol A fumarate resin having a gel content of about 8% by weight. The toner also comprises 3.4% by weight HMDS treated silica, 1.9% by weight DTMS treated titania, 0.1% by weight H2050, a highly hydrophobic fumed silica with a coating of polydimethyl siloxane units and with amino/ammonium functions chemically bonded onto the surface obtained from Wacker Chemie, and 0.5% by weight Zinc Stearate L.

The toner has a volume median particle size of about 8.3 μm, with percent fines less than 5 μm of no more than 15% by number as measured by a Coulter Counter.

This toner is formed into a developer by combining with a carrier comprised of a 80 μm steel core (supplied by Hoganas Corporation) coated with 1% by weight PMMA (supplied by Soken) at 200° C.

Example 3

Comparison of Toner Properties

The toner compositions of Example 1 and Comparative Examples 1 and 2 are tested for their fusing performance.

Toner particles from the respective toners were blended with 2.9% RY50 (Aerosil® fumed silica), 1.3% SMT5103 (SMT-5103 titania available from Tayca Corporation), and 0.5% calcium stearate. Unfused images were prepared using a DC265 Xerox Corporation printer and imaged onto Xerox DCX+, 90 gsm paper. The images were produced at a 0.54 to 0.58 mg/cm$^2$ toner mass per unit area (TMA). The target image for gloss, crease and hot offset was a square, 6.35 cm by 6.35 cm or a rectangle, 6.35 cm by 3.8 cm, positioned near the center of the page.

The samples were fused using a modified oil-less fusing fixture that uses a fluorinated Viton® fuser roll at a fuser nip dwell time of 30 ms.

The toner compositions are tested for their minimum fixing temperature (MFT). MFT is measured as the fusing temperature at which acceptable levels of toner adhesion, such as crease, is obtained. The results are shown in the following Table:

Minimum Fixing Temperature Performance

| Toner | MFT |
|---|---|
| Example 1 | 130° C. |
| Comparative Example 1 | 120° C. |
| Comparative Example 2 | 165° C. |

The results show that the toner of Example 1 exhibits comparable minimum fixing temperature properties to the Comparative Example 1 toner, while providing significant minimum fixing temperature reduction as compared to the conventional Comparative Example 2 toner.

Print gloss (Gardner gloss units or "ggu") was measured using a 75° BYK Gardner gloss meter at a fuser roll temperature range of about 140° C. to about 210° C. Gloss readings were measured parallel and perpendicular to the process direction and the results were averaged (sample gloss is dependent on the toner, substrate and fuser roll). Print gloss properties for the Example 1 particles were about 20 to about 50 ggu. Print gloss for the Comparative Example 1 particles were about 30 to about 67 ggu, and print gloss for the Comparative Example 2 particles were about 12 to about 52 ggu. The results show that the toner of Example 1 exhibits comparable gloss properties to the Comparative Example 1 and 2 toners.

A standard document offset procedure was performed. The toner sample was visually rated for document offset using the Document Offset Grade system wherein grades 5.0 to 1.0 indicate progressively higher amounts of toner offset onto the paper, from slight (5) to severe (1). Grade 5 indicates no toner offset onto paper and no disruption of the image gloss. Grade 4.5 indicates no toner offset, but some disruption of image gloss. An evaluation of greater than or equal to 3.0 is considered an acceptable grade. Document offset performance for the Example 1 and Comparative Example 1 and 2 toners are shown in the following Table:

Document Offset Performance

| Document Offset Performance | | |
|---|---|---|
| Toner | Document Offset Toner/Toner | Document Offset Toner/Paper |
| Example 1 | 4.5 | 2.5 |
| Comparative Example 1 | 4.5 | 1.5 |
| Comparative Example 2 | 1.0 | 1.0 |

While not wishing to be bound by theory, document offset performance is believed to be dependent upon the amount and type of wax used in the toner particles. The results show that the toner of Example 1 exhibits comparable document offset properties to the Comparative Example 1 toner, while providing significant document offset improvement as compared to the conventional Comparative Example 2 toner. Addition of the combination of crystalline polyester wax and the second different wax to the styrene-based polymer resin has been found to provide the comparable results to the comparative polyester-based polymer resin toner composition.

Comparative Example 3

Preparation of Polyester Toner

Comparative toners are obtained that include EDTA as part of the toner formulation. A cyan toner is prepared containing 4.5% by weight PB15:3 colorant dispersion in a styrene/butyl acrylate/beta-carboxy ethyl acrylate terpolymer resin (76%:23.5%:5%) and 7% FNP-0092 wax. EDTA is used in the process of producing the toner, and thus some residual EDTA remains in the final toner composition. The toner has a glass transition temperature of about 51° C.

A black toner is prepared containing 6% by weight R339 and 1% by weight PB 15:3 colorant dispersion in a styrene/butyl acrylate/beta-carboxy ethyl acrylate terpolymer resin (76%:23.5%:5%) and 7% FNP-0092 wax. EDTA is used in the process of producing the toner, and thus some residual EDTA remains in the final toner composition. The toner has a glass transition temperature of about 51° C.

This toners are formed into a developers by combining with a carrier comprised of a 80 μm steel core (supplied by Hoganas Corporation) coated with 1% by weight PMMA (supplied by Soken) at 200° C.

Example 4

Comparison of Toner Properties

The toner composition of Examples 2 and Comparative Example 3 are variously tested for their fusing performance, following the procedures described above in Example 3.

The toner compositions are tested for their crease fix. The results are shown in the following Table:

Crease Fix

| Crease Fix | |
|---|---|
| Toner | MFT (° C.) |
| Example 1 | 130 |
| Example 2 | 133 |
| Comparative Example 3 (cyan) | 143 |
| Comparative Example 2 (black) | 145 |

The results show that the toners of Examples 1 and 2 exhibit comparable crease fix properties to the Comparative Example 3 toners, but have a lower MFT as compared to the Comparative Examples.

Print gloss was also measured, as above. Print gloss properties for the Example 1 particles were about 20 to about 50 ggu, and for the Example 2 particles were about 27 to about 68 ggu. Print gloss for the Comparative Example 3 (cyan) particles were about 17 to about 55 ggu, and print gloss for the Comparative Example 3 (black) particles were about 15 to about 60 ggu. The results show that the toners of Examples 1 and 2 exhibit comparable gloss properties to the Comparative Example 3 toners.

A standard document offset procedure was performed as above. Document offset performance for the Example 1 and Comparative Example 3 (black) toners are shown in the following Table:

Document Offset Performance

| Document Offset Performance | | |
|---|---|---|
| Toner | Document Offset Toner/Toner | Document Offset Toner/Paper |
| Example 1 | 4.5 | 2.5 |
| Comparative Example 3 (black) | 1.5 | 1.0 |

The results show that the toner of Example 1 exhibits provides significant document offset improvement as compared to the conventional Comparative Example 3 toner. Addition of the combination of crystalline polyester wax and the second different wax to the styrene-based polymer resin has been found to provide the comparable results to the comparative polyester-based polymer resin toner composition.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising:

a styrene-based polymer resin;

a crystalline polyester wax;

a second wax different from said crystalline polyester wax, wherein said second wax is other than a crystalline polyester wax;

a colorant; and a coagulant, wherein the toner composition comprises:

aggregated core particles comprising said styrene-based polymer resin, said crystalline polyester wax, said second wax different from said crystalline polyester wax, said colorant, and said coagulant; and a shell formed over said aggregated core particles comprising additional styrene-based polymer resin.

2. The toner composition of claim 1, wherein the styrene-based polymer resin is selected from the group consisting of styrene, styrene acrylates, styrene methacrylates, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), styrene/butyl acrylate/carboxylic acid terpolymers, styrene/butyl acrylate/beta-carboxy ethyl acrylate terpolymers, and mixtures thereof.

3. The toner composition of claim 1, wherein the styrene-based polymer resin is selected from the group consisting of styrene/butyl acrylate/β-carboxy ethyl acrylate terpolymer, styrene/butyl acrylate/acrylic acid terpolymer, styrene/butyl acrylate/methacrylic acid terpolymer, styrene/butyl acrylate/itaconic acid terpolymer, styrene/butyl acrylate/furmaic acid terpolymer, styrene/butadiene /beta-carboxyethylacrylate terpolymer, styrene/butadiene/methacrylic acid terpolymer, styrene/butadiene /acrylic acid terpolymer, styrene/isoprene/beta-carboxyethylacrylate terpolymer and mixtures thereof.

4. The toner composition of claim 1, wherein the styrene-based polymer resin is styrene:butylacrylate:beta-carboxy ethyl acrylate comprising about 70% to about 90% styrene, about 10% to about 30% butylacrylate, and about 0.05 parts per hundred to about 10 parts per hundred beta-CEA.

5. The toner composition of claim 1, wherein the styrene-based polymer resin has a weight average molecular weight of about 25,000 to about 50,000, a number average molecular weight of about 7,000 to about 20,000, and a Tg (onset) of about 48° C. to about 62° C.

6. The toner composition of claim 1, wherein the crystalline polyester wax is selected from the group consisting of aliphatic and aromatic semi-crystalline polyesters.

7. The toner composition of claim 1, wherein the crystalline polyester wax is selected from the group consisting of poly(butylene adipate), poly(hexamethylene sebecate), poly (decamethylene sebecate), poly[hexamethylene-co-tetramethylene (80/20) cyclohexane dicarboxylate], poly[hexamethylene terephthalate-co-succinate (70/30)], poly [hexamethylene-co-tetramethylene (80/20)-terephthalate-co-isophthalate (80/20)], poly[hexamethylene-co-tetramethylene (80/20)-naphthonate-co-isophthalate (80/20)], poly[hexamethylene-co-2,2-dimethyl propylene (80/20)-terephthalate], poly[hexamethylene-co-2,2-dimethylpropylene (80/20) naphthonate], and mixtures thereof.

8. The toner composition of claim 1, wherein the crystalline polyester wax is selected from the group consisting of alkali copoly(5-sulfoisophthaloyl)-co-poly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly (pentylene-adipate), alkali copoly(5-sulfo-iosphthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succiflate), alkali copoly(5-sulfoisophthaloyl-copoly(butylene-succiflate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly (pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly (5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), alkali copoly(5-sulfo-isophthaloyl)copoly(hexylene-adipate), and poly(octylene-adipate).

9. The toner composition of claim 1, wherein the crystalline polyester wax satisfies at least one of the following properties:

a weight average molecular weight of about 5,000 to about 80,000;

a peak melting point of about 50° C. to about 95° C.;

a recrystallization peak temperature of about 45° C. to about 75° C.;

an X-ray diffraction pattern of the crystalline polyester wax has a peak between about 20 and about 26°, as measured at 2theta; and a heat of fusion of about 170 to about 296 J/g.

10. The toner composition of claim 1, wherein the second wax is an alkylene wax present in an amount of about 6% to about 15% by weight based upon the total weight of the composition.

11. The toner composition of claim 1, wherein the second wax has a peak melting point of about 65° C. to about 120° C.

12. The toner composition of claim 1, wherein the colorant comprises a pigment, a dye, or mixtures thereof, in an amount of about 1% to about 25% by weight based upon the total weight of the composition.

13. The toner composition of claim 1, wherein the colorant comprises a pigment dispersion comprising pigment particles having a volume average diameter of about 50 to about 300 nanometers, water, and an anionic surfactant.

14. The toner composition of claim 1, wherein the coagulant is present in the toner composition, exclusive of external additives and on a dry weight basis, in an amount of from 0 to about 5% by weight of the toner composition.

15. The toner composition of claim 1, having a Tg (onset) of from about 50 to about 60° C., a shape factor of about 120 to about 140, a circularity of about 0.900 to about 0.980, and a minimum fixing temperature of about 115° C. to about 145° C.

16. The toner composition of claim 1, comprising about 40% to about 80% styrene-based polymer resin, about 15% to about 40% crystalline polyester wax, about 4% to about 15% second wax, and about 5% to about 13% colorant, by weight based upon the total weight of the composition.

17. The toner composition of claim 1, comprising about 62% styrene-based polymer resin, about 25% crystalline polyester wax, about 9% second wax, and about 4% colorant, by weight based upon the total weight of the composition.

18. A developer comprising:

the toner of claim 1, and a carrier.

19. A method of developing an image, comprising:

applying the tow composition of claim 1 to an image; and fusing said tons composition to the substrate.

* * * * *